US006302774B1

(12) United States Patent
Black

(10) Patent No.: US 6,302,774 B1
(45) Date of Patent: Oct. 16, 2001

(54) ORBITAL DISC SANDER SUPPORT

(76) Inventor: Martin Thomas Black, R.R. #1, Angus, Ontario (CA), L0M 1B0

( * ) Notice: Subject to any disclaimer, the term of this patent is extended or adjusted under 35 U.S.C. 154(b) by 0 days.

(21) Appl. No.: 09/489,370

(22) Filed: Jan. 21, 2000

(51) Int. Cl.[7] ..... B24B 23/00
(52) U.S. Cl. ..... 451/490
(58) Field of Search ..... 451/56, 441, 443, 451/357–359, 444, 539, 552

(56) References Cited

U.S. PATENT DOCUMENTS

| | | | | |
|---|---|---|---|---|
| Re. 29,247 | * | 6/1977 | Kilstrom et al. | 451/357 X |
| 3,841,031 | * | 10/1974 | Walsh | 51/283 |
| 4,287,685 | * | 9/1981 | Marton | 451/490 X |
| 5,309,682 | * | 5/1994 | Gutknecht et al. | 451/490 |
| 5,384,986 | * | 1/1995 | Hirose et al. | 451/444 |
| 5,419,737 | * | 5/1995 | Brazell et al. | 451/357 X |
| 5,868,605 | * | 2/1999 | Cesna | 451/443 X |

* cited by examiner

*Primary Examiner*—Joseph J. Hail, III
*Assistant Examiner*—Anthony Ojini

(74) *Attorney, Agent, or Firm*—Blackwell Sanders Peper Martin

(57) ABSTRACT

An orbital disc sander support is provided which may support an active orbital disc sander in a stationary position so that an operator can attend to other tasks without having to de-activate the sander or worry that the sander will fall off of the work area. This both helps to protect the sander and increases operator efficiency by eliminating time wasted waiting for the orbital disc to reach its operating speed or to stop before continuing with the next task. The support has a turntable, which includes a platform rotatably mounted to a base, and may employ a retaining wall for retaining the sander. The base may be provided with a cushion to absorb vibrations and to prevent the base from slipping off the work area. Alternatively, the base may simply be secured to the work area. The platform may also be provided with a rubber pad to help clean the sanding disc surface of the orbital disc sander. This cleaning action may extend the life of the sanding disc surface; thereby increasing efficiency by reducing how frequently the sanding disc surface must be replaced. Additionally, the platform may be provided with a hole to allow any grit or dust that has been removed from the sander surface to escape.

14 Claims, 2 Drawing Sheets

ORBITAL DISC SANDER SUPPORT

FIELD OF THE INVENTION

This invention relates to the field of workshop accessories that may be used to complement orbital disc sanders.

BACKGROUND OF THE INVENTION

Over the last ten years orbital disc sanders have gained acceptance in the marketplace. Orbital disc sanders are characterised by a rotational and orbital motion of the sanding disc surface. This combined motion is in contrast with the purely orbital motion of more traditional random orbital sanders.

Orbital disc sanders need to be stopped before they are set down, otherwise they are likely to vibrate off of the work surface and fall to the ground where they may be damaged. Due to the rotational inertia of the rotating sanding head, the head may take over ten seconds to fully stop. As such, every time the operator of an orbital disc sander needs to attend to a different task there is time wasted waiting for the sander to completely stop.

The sanding surface of orbital disc sanders comprises of a disc shaped sanding sheet that is attached to the sanding head with a pressure sensitive adhesive or a hook and loop fastener. These sanding disc sheets must routinely be replaced when their surface wears out or becomes packed with dust and grit. Industries that intensively use orbital disc sanders can spend considerable amounts of time and money replacing the sanding disc sheets.

SUMMARY

In accordance with an aspect of the present invention there is provided a sander support for a sander with a rotating head having a flat sanding surface, comprising: a turntable comprising a base and a platform rotatably mounted to the base, the platform having a hole for expelling dust and grit removed from the flat sanding surface; a retainer extending upwardly, from one of the platform and the base, about a periphery of the platform so as to define a space for reception of the rotating head in order to retain the sander on the platform; and a pad carried by the platform on which the flat sanding surface of the rotating head may rest for removing dust and grit from the sanding surface.

In accordance with another aspect of the present invention there is provided a combination of a turntable and an orbital disc sander, comprising: a turntable; an orbital disc sander with a rotating sanding head; and a retainer extending from the turntable retaining the rotating sanding head of the orbital disc sander on the turntable.

In accordance with another aspect of the present invention there is provided a sander support for supporting a sander with a rotating sanding head having a flat sanding surface, comprising: a base; a thrust bearing; a platform rotatably mounted to the base with the thrust bearing, the platform having a hole for expelling dust and grit removed from the flat sanding surface; a retaining wall extending upwardly from the platform, the wall and platform defining a space for receiving the rotating sanding head for retaining the sander; a rubber pad inserted above the platform in the space defined by the wall and the platform, for cleaning the flat sanding surface of the rotating sanding head; and a non-skid pad attached below the base for absorbing vibration.

In accordance with another aspect of the present invention there is provided a process for cleaning a sander with a rotating sanding head having a flat sander surface, comprising: rotating the sanding head; and placing the flat sanding surface of the rotating sanding head on a pad carried by a rotatable platform of a turntable while said platform with pad is stationary so that dust and grit is removed from said flat sanding surface by virtue of the sliding frictional contact between the flat sanding surface and the pad.

The present invention may be used in combination with an orbital disc sander to prevent the sander from falling off the work surface when it is set down while running and to help clean the sanding disc surface. These characteristics may increase operator efficiency by avoiding the need to stop and re-start the sander whenever an operator must attend to a different task, reduce costs by extending the life of the sanding disc surface, and protect the sander by preventing it from falling to the ground.

BRIEF DESCRIPTION OF THE DRAWINGS

The present invention will be further understood from the following detailed description, with reference to the drawings in which.

DETAILED DESCRIPTION OF THE PREFERRED EMBODIMENT

Figure 1:
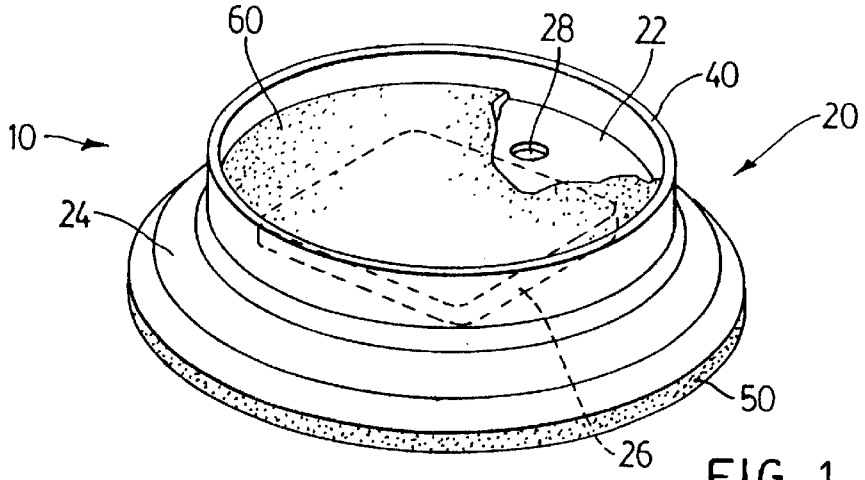
FIG. 1 is a perspective view of an orbital disc sander support in accordance with a preferred embodiment of the present invention.
Figure 2:
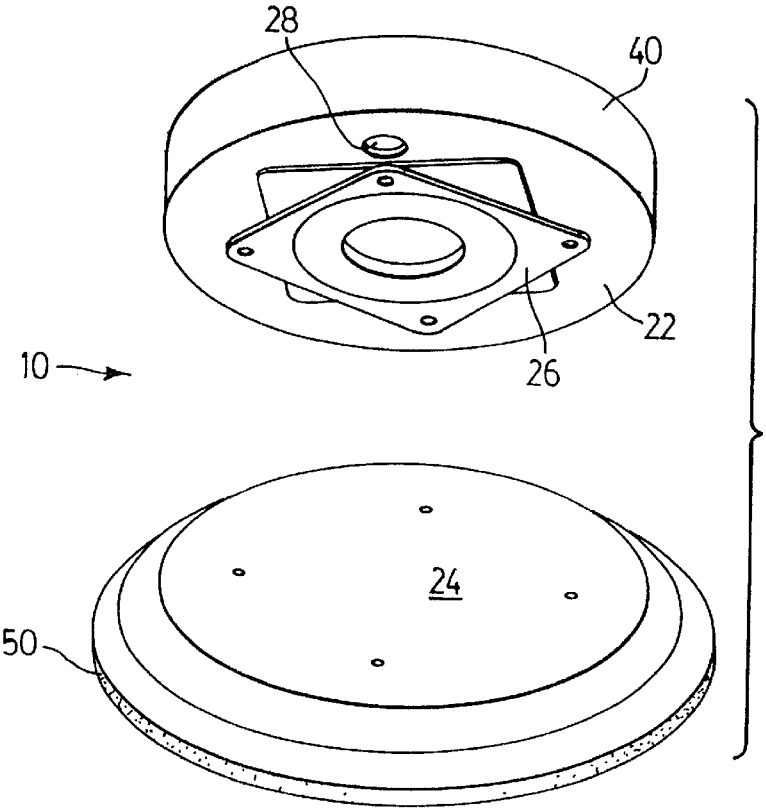
FIG. 2 is an assembly view of the orbital disc sander support in FIG. 1.
Figure 3:
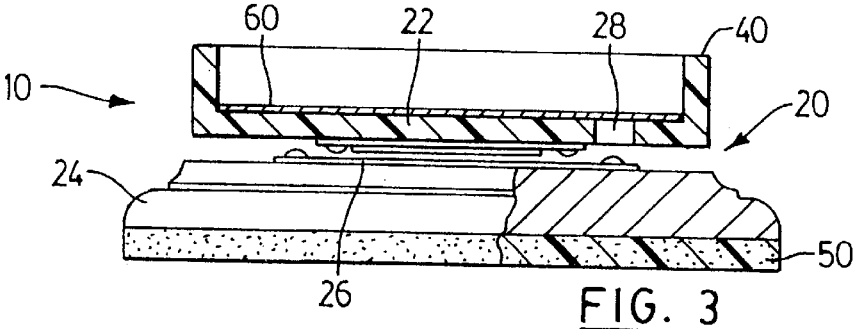
FIG. 3 is a partially cross-sectioned side view of the orbital disc sander support in FIG. 1.

Referencing FIGS. 1 to 4, an orbital disc sander support 10 comprises a turntable 20 with a horizontal platform 22 that is rotatably mounted to base 24 by a flanged thrust bearing 26, commonly referred to as a "lazy susan bearing". It will be understood that a number of other bearing types and mechanisms may be employed to rotatably mount platform 22 to base 24.

Orbital disc sander support 10 is designed to rest upon or be affixed to a work surface (not shown), like a worktable, and to receive the rotating sanding head of a running orbital disc sander. A sanding disc surface, typically a disc sanding sheet, is affixed to the bottom of the sanding head with a pressure sensitive adhesive or a hook and loop fastener (not shown).

Figure 4:
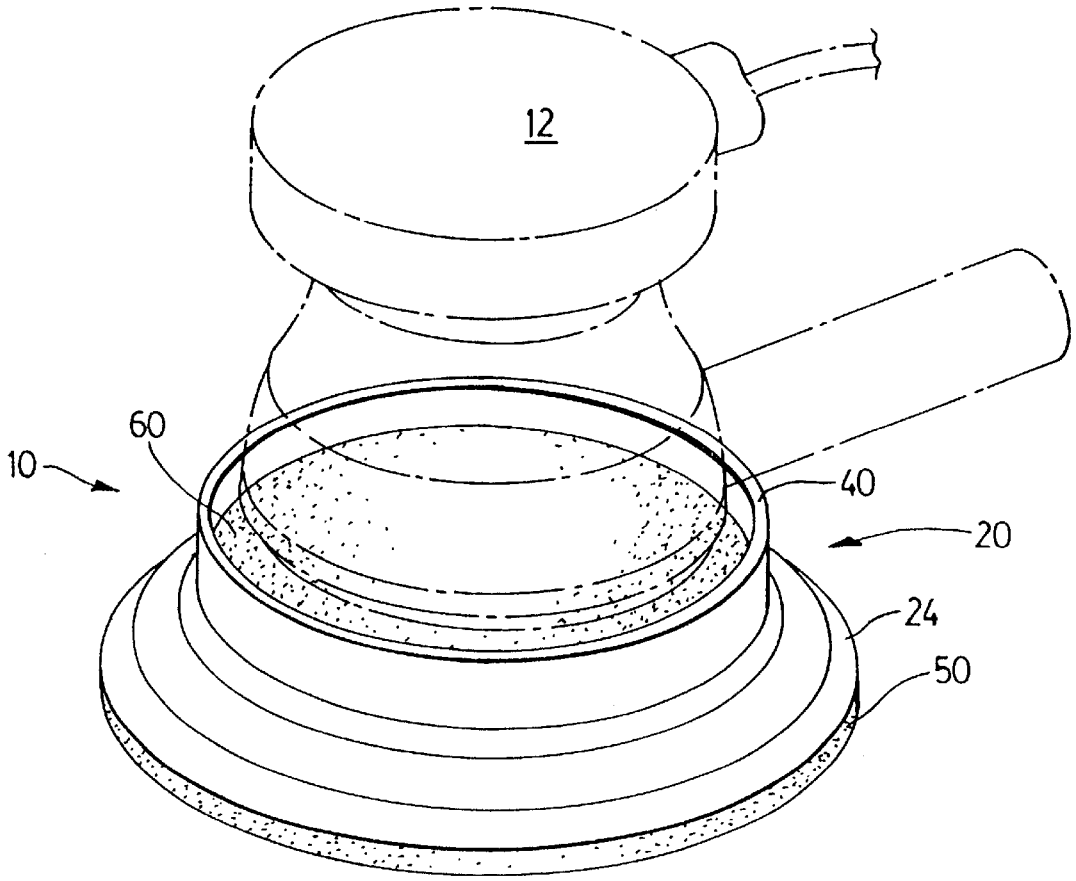
FIG. 4 is a perspective view of the orbital disc sander support in FIG. 1 in combination with an orbital disc sander shown in outline.

A retaining wall 40 extends upwards from platform 22 to define a space to receive the rotating sanding head of an orbital disc sander 12 (shown in outline in FIG. 4). Retaining wall 40 prevents running orbital disc sander 12 from falling off platform 22. Preferably, platform 22 is a circular disc with a diameter slightly larger than the diameter of the sanding head of orbital disc sander 12 and retaining wall 40 forms a short cylinder that extends upwards from the peripheral edge of platform 22. However, it will be understood that platform 22 may be any shape capable of supporting running orbital disc sander 12. It will also be understood that retaining wall 40 may be replaced with any retainer capable of retaining running orbital disc sander 12 on platform 22, such as a lip, a railing, a bar, a series of retaining pins, or an arm, extending from platform 22 or base 24, so as to surround platform 22.

Since the vibration and rotation of a running orbital disc sander 12 resting on platform 22 may cause base 24 to shake or vibrate with respect to the work surface, a non-slip cushion 50 made of omalon™ is affixed to the bottom of base 24. However, it will be understood that any material with anti-vibrational and non-slip properties may be employed to make cushion 50. Also, as an alternative to employing cushion 50, base 24 may simply be affixed to the work surface with bolts, screws, clamps, adhesives or vacuum seals (not shown.) Preferably, base 24, platform 22 and retaining wall 40 are made from injection moulded plastic. However, any sufficiently sturdy material such a wood or metal will suffice.

A pad 60, preferably made of "L" grade natural crumb rubber, also known as crude rubber, is cut to fit the space defined by wall 40 and is inserted into the space so as to be carried by platform 22.

When an active orbital disc sander 12 first comes in contact with pad 60 of platform 22, sliding friction between the sanding disc surface of the rotating sanding head of orbital disc sander 12 and pad 60 torques platform 22 causing it to rotate with respect to base 24 up to the speed of the rotating sanding head. Thus, when the sanding disc surface of the rotating sanding head of orbital disc sander 12 comes into contact with pad 60 there is initially some slippage between the sanding surface and pad 60. Further slippage between the sanding surface and pad 60 is caused by the orbital motion of the sanding head. Due to the texture and rough surface of the natural crumb rubber, this slippage helps to remove dust and grit that may have been packed into the sanding disc surface. This cleaning action tends to extend the useful life of the sanding disc surface, which reduces the time and expense associated with its periodic replacement.

Moreover, the absence of impurities or artificial colouring in natural crumb rubber prevents pad 60 from staining the sanding disc surface of orbital disc sander 12, which stain could later be transferred to the surface that is being sanded.

Whenever running orbital disc sander 12 is removed from sander support 10, the centrifugal force caused by the rotation of platform 22 and pad 60 urges the dust and grit removed from the sanding disc surface to move outward to wall 40 where it further tends to fall below pad 60 due to the influence of gravity. This tends to keep the upper surface of pad 60 clean. To further aid in this cleaning, platform 22 is provided with hole 28 to help remove any dust and grit that accumulates below pad 60.

It will be appreciated that orbital disc sander support 10 may equally be used to support any sander that employs flat rotating sanding surface.

Other modifications will be apparent to those skilled in the art.

What is claimed is:

1. A sander support for a sander with a rotating head having a flat sanding surface, comprising:

(a) a turn table comprising a base and a platform rotatably mounted to said base, said platform having a hole for expelling dust and grit removed from the flat sanding surface, (b) a retainer extending upwardly, from one of said platform and said base, about a periphery of said platform so as to define a space for reception of the rotating head in order to retain the sander on said platform; and (c) a pad carried by said platform on which the sanding surface of the rotating head may rest for removing dust and grid from the flat sanding surface.

2. The sander support of claim 1, wherein said retainer comprises a wall extending upwardly from said platform.

3. The sander support of claim 1 wherein said pad is made of natural crumb rubber.

4. The sander support of claim 1 further comprising:

(d) a non-slip cushion attached under said base.

5. The sander support of claim 4 wherein said non-slip cushion is made of omalon™.

6. A combination of a turntable and an orbital disc sander, comprising:

(a) a turntable;

(b) an orbital disc sander with a rotating sanding head; and (c) a retainer extending from said turntable retaining said rotating sanding head of said orbital disc sander on said turntable.

7. The combination of claim 6 Wherein said turntable comprises a base and a platform rotatably mounted to said base.

8. The combination of claim 7 wherein said retainer comprises a wall extending upwardly from said platform, said wall and said platform defining a space to receive said rotating sanding head.

9. The combination of claim 8 further comprising;

(d) a rubber pad inserted between said platform and said rotating sanding head in the space defined by said wall and said platform.

10. A sander support for supporting a sander with a rotating sanding head having a flat sanding surface, comprising:

(a) a base;

(b) a thrust bearing;

(c) a platform rotatably mounted to said base with said thrust bearing, said platform having a hole for expelling dust and grit removed from the flat sanding surface;

(d) a retaining wall extending upwardly from said platform, said wall and platform defining a space for receiving the rotating sanding head for retaining the sander;

(e) a rubber pad inserted above said platform in the space defined by said wall and said platform, for cleaning the flat sanding surface of the rotating sanding head; and (f) a non-skid pad attached below said base for absorbing vibration.

11. A process for cleaning a sander with a rotating sanding head having a flat sander surface, comprising:

(a) rotating the sanding head; and (b) placing the flat sanding surface of the rotating sanding head on a pad carried by a rotatable platform of a turntable while said platform with pad is stationary so that dust and grit is removed from said flat sanding surface by virtue of the sliding frictional contact between the flat sanding surface and the pad.

12. The process of claim 11 wherein, when placing the flat sanding surface of the rotating sanding head on said platform with pad, the platform with pad rotates at a speed lower than that of said sanding head.

13. The process of claim 11 further comprising allowing the rotational speed of the platform of the turntable to increase due to said sliding frictional contact to substantially match the rotational speed of the sanding head whereby dust and grit are urged towards the outer periphery of the platform by centrifugal force.

14. The process of claim 13 wherein rotational torque applied to said rotatable platform is applied only by said rotating sanding head.

* * * * *